US008129648B2

(12) United States Patent
Zimmermann et al.

(10) Patent No.: US 8,129,648 B2
(45) Date of Patent: Mar. 6, 2012

(54) SURGE ARRESTER HAVING THERMAL OVERLOAD PROTECTION

(75) Inventors: Gero Zimmermann, Berlin (DE); Thomas Westebbe, Berlin (DE); Peter Bobert, Falkensee (DE)

(73) Assignee: EPCOS AG, Munich (DE)

( * ) Notice: Subject to any disclaimer, the term of this patent is extended or adjusted under 35 U.S.C. 154(b) by 105 days.

(21) Appl. No.: 12/783,346

(22) Filed: May 19, 2010

(65) Prior Publication Data

US 2010/0314358 A1 Dec. 16, 2010

Related U.S. Application Data

(63) Continuation of application No. PCT/EP2008/066015, filed on Nov. 21, 2008.

(30) Foreign Application Priority Data

Nov. 21, 2007 (DE) ..... 10 2007 056 165

(51) Int. Cl.
*H01H 33/02* (2006.01)

(52) U.S. Cl. ..... 218/158; 361/119

(58) Field of Classification Search ..... 218/154–158; 361/119

See application file for complete search history.

(56) References Cited

U.S. PATENT DOCUMENTS

| | | | | | |
|---|---|---|---|---|---|
| 2,295,320 | A | | 9/1942 | Allen | |
| 2,504,438 | A | | 4/1950 | McFarlin | |
| 4,004,263 | A | | 1/1977 | Carney | |
| 4,015,228 | A | | 3/1977 | Eda et al. | |
| 4,158,869 | A | * | 6/1979 | Gilberts | 361/118 |
| 4,191,987 | A | * | 3/1980 | Coren | 361/124 |
| 4,493,003 | A | * | 1/1985 | Mickelson et al. | 361/119 |
| 4,866,562 | A | * | 9/1989 | Jones | 361/119 |
| 5,014,036 | A | * | 5/1991 | Komoto | 337/407 |
| 5,198,791 | A | | 3/1993 | Shibayama et al. | |
| 5,706,161 | A | | 1/1998 | Adam | |
| 5,959,517 | A | * | 9/1999 | Wieloch et al. | 335/16 |
| 6,483,420 | B1 | * | 11/2002 | Takahashi et al. | 337/401 |
| 7,399,451 | B1 | * | 7/2008 | Heed | 422/175 |
| 2008/0218082 | A1 | | 9/2008 | Boy et al. | |

FOREIGN PATENT DOCUMENTS

| | | | |
|---|---|---|---|
| DE | 1 006 946 | | 4/1957 |
| DE | 196 19 334 | A1 | 11/1997 |
| DE | 100 25 685 | A1 | 11/2001 |
| DE | 10 2005 036 265 | A1 | 2/2007 |
| DE | 10 2007 024 622 | A1 | 10/2008 |
| EP | 1 077 452 | A2 | 2/2001 |
| FR | 2 574 589 | A1 | 6/1986 |
| GB | 1066011 | | 4/1967 |

* cited by examiner

*Primary Examiner* — Truc Nguyen
(74) *Attorney, Agent, or Firm* — Slater & Matsil, L.L.P.

(57) ABSTRACT

An overvoltage arrester includes at least two electrodes and a melt element that connects one of the electrodes to an outer terminal of the overvoltage arrester. An extinguishing device is designed to extinguish an electric arc.

19 Claims, 2 Drawing Sheets

SURGE ARRESTER HAVING THERMAL OVERLOAD PROTECTION

This application is a continuation of co-pending International Application No. PCT/EP2008/066015, filed Nov. 21, 2008, which designated the United States and was not published in English, and which claims priority to German Application No. 10 2007 056 165.4, filed Nov. 21, 2007, both of which applications are incorporated herein by reference.

TECHNICAL FIELD

The invention relates to an overvoltage arrester with thermal overload protection, as well as to its use and to a method for protecting an overvoltage arrester from thermal overload.

BACKGROUND

An overvoltage arrester is known from DE 10 2005 036 265 A1 and U.S. equivalent Patent Publication No. 2008/0218082.

SUMMARY

Thermal overload protection for an overvoltage arrester and a method that reliably and easily protects the overvoltage arrester from thermal overload are disclosed. Furthermore a use is disclosed.

The overvoltage arrester has at least two electrodes; it could involve both a dual-electrode and also a triple-electrode overvoltage arrester. By means of a tubular isolator, advantageously a ceramic cylinder, as well as outer electrodes or outer terminals arranged on its ends, the overvoltage arrester forms an internal space. In the internal space, the at least two electrodes are soldered or welded to the outer terminals and typically face each other as pin electrodes or one is constructed as a tubular electrode and the other as a pin electrode that extends into the tubular electrode. The internal space of the overvoltage arrester is closed gastight relative to the surroundings and contains a gas.

Overvoltage arresters are used, in particular, to short or to discharge to ground high, pulse-shaped voltages of a few kV and currents of a few kA in a very short time. A load lasting for a long time in the case of an error, for example, when a grid current is shorted via the power grid or via a telecommunications network or a voltage arrester (power cross), can result in impermissibly high heating of the overvoltage arrester, which could lead to a fire. On the other hand, in the case of loading with direct or alternating voltages or with direct or alternating currents, an overvoltage arrester is thermally loaded. This can occur, from time to time, also in the case of lightning protection applications. Overvoltage arresters in the field of grid protection, for example, for supplying power to buildings, are used for protecting the grid from lightning strike currents and from overvoltages.

In the case that a certain limit voltage is exceeded in the internal space of the overvoltage arrester, electric arcing is generated. The electric arc is maintained by the feed current as long as the electrical conditions for the electric arc are there. The electric arc generates a thermal load on the overvoltage arrester which may not exceed specified values for the overvoltage arrester and for its installation environment. With impermissibly high heating, there is the risk of the overvoltage arrester catching fire.

One of the at least two electrodes of the overvoltage arrester is connected, in the normal case and under normal operating conditions, to the associated outer terminal of the overvoltage arrester with the help of a melt element. The melt element creates an electrical contact and connects the electrode to the outer terminal mechanically.

The overvoltage arrester further contains an extinguishing device that is designed to extinguish an electric arc. The electric arc burns either between the two electrodes as a response of the overvoltage arrester or is generated between the one electrode and the outer terminal when the melt element reacts and melts. The extinguishing device is triggered by the melting of the melt element when the load is too high. The electric arc is extinguished in that the path that the electric arc covers or can cover from the one electrode to the other electrode or to the outer electrode of the overvoltage arrester is made longer. By extinguishing this electric arc, the electric circuit that is closed during the electric arcing between the electrodes of the overvoltage arrester and the voltage or current source connected to the outer terminals is separated. In this way, an electric circuit is broken, so that no further thermal loading is realized.

The overvoltage arrester with an extinguishing device is designed so that the outer integrity of the overvoltage arrester is maintained even when the extinguishing device is triggered. Outer integrity means that the housing arrangement of the overvoltage arrester is kept undamaged and no parts are detached or broken off that could cause damage outside of the overvoltage arrester. The extinguishing device is advantageously arranged completely within the internal space of the housing of the overvoltage arrester.

By extinguishing the electric arc, thermal overloading that could result in impermissibly high heating of the overvoltage arrester and the overvoltage arrester catching fire is prevented. Simultaneously, it is possible that a gas or medium extinguishing the electric arc flows from the outer region of the overvoltage arrester into the internal space of the overvoltage arrester or into the surroundings of the extinguishing device and an electric arc generated by the separating process is extinguished.

In one advantageous embodiment, the melt element has the properties of a low-melting-point solder. As alternatives, a soft solder or a hard solder can be used. Therefore, it is guaranteed that, for the case of thermal loading of the overvoltage arrester, the solder of the melt element is melted first before the other elements of the overvoltage arrester can be damaged. The melting solder triggers the extinguishing device, and an already existing electric arc or an electric arc generated by the melting process is extinguished.

In a preferred embodiment, the melt element is constructed to melt in the case of impermissible heating and to cause the extinguishing device to move the one electrode into a position farther away from the other electrode of the overvoltage arrester or to increase the distance between these electrodes. Through the movement of the one electrode relative to the other electrode, this embodiment allows not only for the provision of an increase in the distance between these two elements, but also for movement of the one electrode from the internal space of the overvoltage arresters so far that this reliably becomes inoperable. In this way, especially efficient protection is achieved against thermal overloading of the overvoltage arrester and the device that it protects.

In another preferred embodiment, the melt element is constructed to melt when heated and to cause the extinguishing device to move an insulation element between the outer terminal and the one electrode. Preferably, the one electrode has a multiple-part construction and contains, in addition to the main electrode of the actual overvoltage arrester, an auxiliary electrode with which the electrode is fixed in the overvoltage arrester. Furthermore, the electrode has a pin or peg pointing away from the internal space of the overvoltage arrester, with this pin or peg being connected electrically to the outer electrode by means of the melt element. The melt element is constructed so that a gap is formed between the outer electrode and the one electrode connected to it. For the case of impermissible heating of the overvoltage arrester and when the melt element melts, an insulation element moves into this gap, so that the connection between the outer terminal and the one electrode is separated and broken.

In an especially preferred embodiment, the extinguishing device has a spring with which the movements required for the insulation are realized. The spring has the advantage that, on one hand, it biases the melt element mechanically and when the melt element is triggered, an efficient movement of the electrode to be guided or the insulation element is realized by relaxing the spring tension, in order to realize insulation. According to the shape, the spring is provided as a compression spring or as a tension spring. A compression spring, however, has the special advantage that the spring can be supported easily.

In another especially advantageous embodiment, the extinguishing device is arranged in a space separated from the electrode of the overvoltage arrester not connected to the melt element. This embodiment allows the optimization of, on one hand, the internal space of the actual overvoltage arrester formed by the electrodes and the insulator optimally to the specifications of the overvoltage arrester. On the other hand, the separated space that holds the extinguishing device can be designed optimally for the function to be fulfilled by the extinguishing device. For example, it is possible to use materials for the separated space and the extinguishing device that can withstand an electric arc generated by the separating process or the electric arc during the process of the extension of the electrode spacing, without catching fire. Furthermore, the separated space could contain a gas or a medium that helps in the triggering of the melt element or the use of the extinguishing device to extinguish the generated electric arc as efficiently as possible.

In one embodiment in which the one electrode of the overvoltage arrester is set apart from the other electrode by means of the extinguishing device, the spring is constructed in an especially preferred way as a compression spring that is biased in the normal state, that is, without the reaction by the melt element, between the outer terminal and the one electrode. In this way, it is possible that, when the melt element melts, the spring tension is relaxed and through this movement, the electrode is pulled out from the internal space of the overvoltage arrester and separates from the outer terminal.

In an embodiment in which, in the triggered case of the melt element, an insulation element is moved between the one electrode and the outer terminal, it is especially advantageous to provide on the outer electrode a support for a compression spring so that the compression spring tension relaxes in the triggered case of the melt element and moves the insulation element between the one electrode and the outer terminal. In this case, the shape of the insulation element is adapted to the shape of the electrode. For the case of a pin electrode, the insulation element preferably has the shape of a pot whose walls move between the pin electrode and the outer terminal and against whose base the compression spring presses.

In modified embodiments, a construction of the spring as a tension spring is provided.

For a melted melt element, it is possible to activate a contact element when the end position is reached after the movement of the one electrode. Through the spring and the contact element, an electric contact is closed and an electric signal is generated. This electric signal can be used for further processing, for example, for displaying the functional state of the overvoltage arrester.

With special advantage, the overvoltage arrester can be used in a device that places high demands on both trouble-free functioning and also with respect to thermal and other loading. Belonging to this type of device are, for example, a power grid, e.g., in a building, or a telecommunications device or a telecommunications network that can be protected efficiently from lightning and other overvoltages with the overvoltage arrester. The overvoltage arrester is not limited in its use and can also be used for any other electric circuit in which high voltages must be discharged by means of an overvoltage arrester.

For the case of a method for protecting an overvoltage arrester described above from thermal overload, the following steps are provided. In the case of impermissibly strong heating of the overvoltage arrester, the overvoltage arrester heats up on the melt element that is designed so that it melts for impermissibly strong thermal loading before other parts of the overvoltage arrester can catch fire. By the melting of the melt element, in a next step, an extinguishing device is triggered that extends a section starting from the one electrode of the overvoltage arrester to the other electrode of the overvoltage arrester or to the outer electrode. The extension of the section is realized such that, for the case of a preferred processing step, the electrode is moved away from the other electrode and is set farther away from this electrode in its end position. In this way, the outer integrity of the overvoltage arrester is maintained.

In another preferred processing step, with the help of the extinguishing device, an insulation element moves into one space between the one electrode and the outer electrode. The one space is formed by melting the melt element and opened for the movement of the insulation element.

In another preferred processing step, for the melting of the melt element, a contact element that generates an electric signal and forwards it to a display or control device is activated with the help of the extinguishing device.

BRIEF DESCRIPTION OF THE DRAWINGS

The arrangement and the method are explained in more detail below with reference to embodiments and associated figures. The embodiments shown in the figures of the drawing are not to be regarded as true to scale and are shown purely schematically for explaining the elements and the method. Identical elements or elements with the identical function are provided with identical reference symbols.

FIG. 1, show an overvoltage arrester according to a first embodiment in the normal state and after triggering of the extinguishing device; FIG. 2, show an overvoltage arrester according to a second embodiment in the normal state and after triggering of the extinguishing device.

Figure 1A:
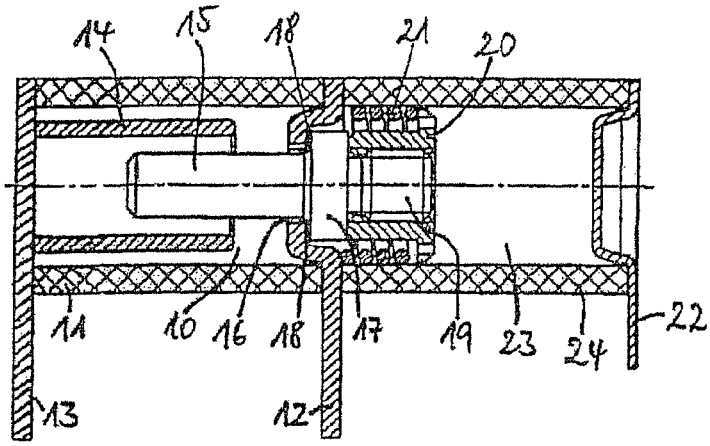
FIGS. 1*a* and 1*b*, collectively

The following list of reference symbols may be used in conjunction with the drawings:

10 Internal space
11 Insulation tube
12, 13, 36 Outer terminal
14, 15, 30 Electrodes of the overvoltage arrester
16, 37 Hole of an outer electrode
17 Head of an electrode
18, 40 Melt element
19, 33 Outer pin of an electrode of the overvoltage arrester
20 Holder
21, 42 Compression spring

22 Terminal of the extinguishing device
23 Internal space of the extinguishing device
24 Tubular insulating part
31 Inner electrode of an electrode
32 Middle electrode of an electrode
33 Outer pin of an electrode
34 Head of an outer pin of an electrode
35 Insulation body
38 Edge of an outer electrode
39 Housing
41 Insulation element

DETAILED DESCRIPTION OF ILLUSTRATIVE EMBODIMENTS

Figure 1B:
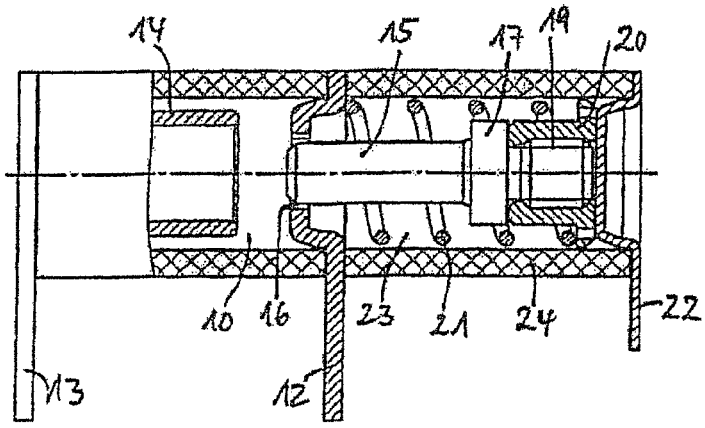

FIG. 1 shows schematically a first embodiment of an overvoltage arrester. FIG. 1*a* shows the normal state, and FIG. 1*b* shows the state after triggering the extinguishing device.

According to FIG. 1*a*, the overvoltage arrester has an internal space 10 as a discharge space that is formed by a tubular insulator 11 and two outer electrodes 12 and 13 formed on the outsides of the insulator. As the arrester section, the internal space 10 of the overvoltage arrester contains a tubular electrode 14 that is connected to the outer electrode 13 and a pin electrode 15 that projects into the tubular electrode 14 and that is connected to the outer electrode 12.

The outer electrode 12 is formed with a bowl shape and projects with its bowl into the internal space 10 of the overvoltage arrester. The bowl base contains a hole 16 through which the pin electrode 15 is guided. Outside of the internal space 10, the pin electrode 15 has a head 17 whose outer diameter is greater than the inner diameter of the hole 16. The pin electrode 15 with head 17 is connected to the outer terminal 12 with the help of a melt element 18.

The melt element 18 is advantageously constructed as soft solder or hard solder, so that, in the shown normal state, there is a good electrically conductive connection between the pin electrode 15 and the outer electrode 12. The melt element 18 is constructed so that it covers the bowl base and optionally projects into the hole 16 of the outer electrode 12. The side of the head 17 of the pin electrode 15 facing the internal space 10 forms a close fit on the bowl base, so that the pin electrode 15 is guided exactly into the internal space.

On the side of the pin electrode 15 facing away from the internal space 10, the head 17 has a peg 19 on which a holder 20 is screwed. A compression spring 21 that is supported both against the outer electrode 12 and also the holder 20 is arranged between the holder 20 and the outer electrode 12. In the embodiment, the holder 20 is guided in a tube 24 that is closed, on the one hand, by the outer electrode 12 and, on the other hand, by a terminal 22. The terminal 22 likewise has a bowl-shaped construction and projects with its bowl base into the internal space 23. The peg 19 of the pin electrode 15, the holder 20, and the compression spring 21 form the extinguishing device in connection with the melt element 18.

According to FIG. 1*b*, the overvoltage arrester is shown after triggering of the melt device. Here it can be seen that the melt element 18 has melted and the pin electrode 15 has been moved out from the internal space 10 of the overvoltage arrester by the force of the spring 21. Through the melting of the melt element 18, the compression spring 21 is changed from the biased position according to FIG. 1*a* into a tension-relaxed position according to FIG. 1*b*. The movement of the pin electrode 15 from the internal space 10 of the overvoltage arrester is absorbed by the terminal 22 that forms a contact or closes in connection with the spring and the outer electrode. The section formed between the two electrodes of the overvoltage arrester or their spacing is made longer so that the generated electric arc is extinguished.

In principle, it is not necessary that the extinguishing device is guided into a separate space 23, as long as it is ensured by structural measures that, when the extinguishing device is triggered, the outer integrity of the overvoltage arrester is maintained and no parts are detached. The device made from the cylindrical tube 24 and the terminal 22, however, is advantageous, because in this way, on the one hand, an uncontrolled movement of the pin electrode 15 from the overvoltage arrester is prevented. On the other hand, it is possible to fill the internal space 23 with a gas or a medium that flows, for movement of the pin electrode 15 into the space 23, through the created opening 16 into the internal space 10 of the overvoltage arrester and helps to extinguish an electric arc between the pin electrode 15 and the tubular electrode 14.

Figure 2A:
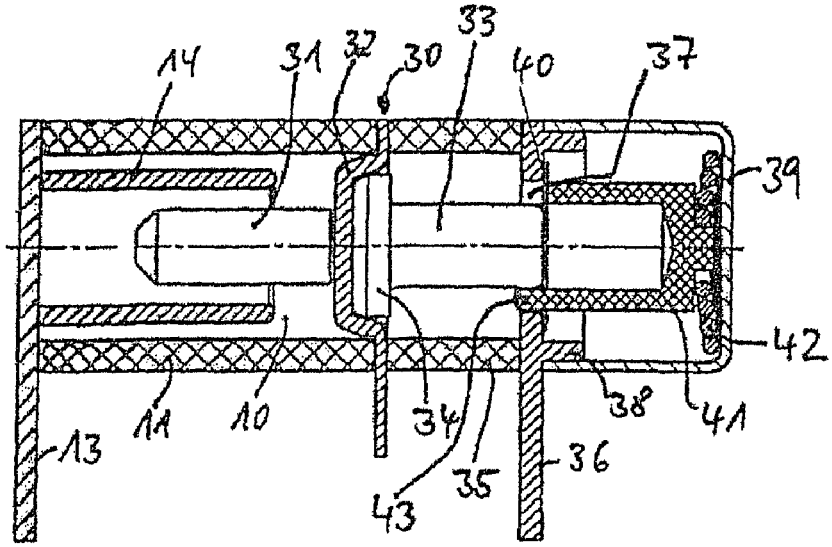
FIGS. 2*a* and 2*b*, collectively

According to FIG. 2*a*, as before, an overvoltage arrester is formed by means of an insulation tube 11, advantageously made from ceramic or plastic, and an outer electrode 13. The outer electrode 13 carries, in the internal space 10 of the overvoltage arrester, an electrode 14 that is tubular in the embodiment, but that could also have a pin-shaped construction. The counter electrode 30 to the electrode 14 has a multipart construction. In the internal space 10 of the overvoltage arrester, it contains the pin electrode 31 that projects into the tubular electrode 14. Alternatively, the two electrodes 14 and 31 can be constructed as opposing pin electrodes.

The internal space 10 of the overvoltage arrester is closed by an auxiliary electrode 32 that has a bowl-shaped construction and whose bowl base projects into the internal space 10 and carries the pin electrode 31. The pin electrode 31 is soldered or welded, for example, to the middle electrode 32. On the side facing away from the internal space 10, the electrode 30 has a peg 33 with a head 34. The head 34 is adapted so that it fits in the bowl of the middle electrode 32 and is soldered or welded to this electrode. The peg 33 or the electrode part 33 formed as a pin electrode is surrounded by an insulation tube 35 that is arranged between the middle electrode 32 and an outer electrode 36 of the overvoltage arrester.

The outer electrode 36 is shaped so that, on the one hand, it allows a tight connection to the insulation tube 35 and, on the other hand, it has a central hole 37 whose diameter is greater than the diameter of the peg 33 of the electrode 30. The insulation tube 35 advantageously has the same outer and inner diameter as the insulation tube 11 of the actual discharge section of the overvoltage arrester. However, it is not necessary that the insulation tube 35 must be made from the same material as the insulation tube 11. Preferably, however, the insulation tube 35 is also a ceramic tube.

On the side facing away from the insulation tube 35, the outer electrode 36 has an edge 38 that forms two steps of the outer electrode 36. The outer step allows the attachment of a housing part 39 that is provided as a holding device for the spring of the extinguishing device. For the case of a tension spring, the housing part 39 could also be eliminated. The step of the outer electrode 36 facing the internal space holds a solder disk 40. The surface of this step is flush with the base of the peg 33 that lies opposite the head 34.

The solder disk 40 is constructed so that the step of the outer electrode 36 forms a good electrical connection to the peg 33 of the one electrode 30. On the space or gap 37 formed between the outer electrode 36 and the peg 33 of the one electrode, an insulating pot 41 presses on the outside. The pot 41 has an edge thickness that may be, at most, equal to the difference of the outer diameter of the peg 33 to the inner diameter of the outer electrode 36. A compression spring 42 that biases the insulation element 41 against the melt element 40 in the shown normal state is tensioned between the base of the insulating pot 41 and the outer housing 39. In the shown embodiment, the insulating pot 41 has an extension 43 that does not extend past the entire edge of the pot and that points through the melt element 40 into the space 37 between the outer electrode 36 and the inner electrode 30. In the case of the melting of the melt element, this extension allows the insulation element 41 to be guided on the peg 33 and not to become tilted.

Figure 2B:
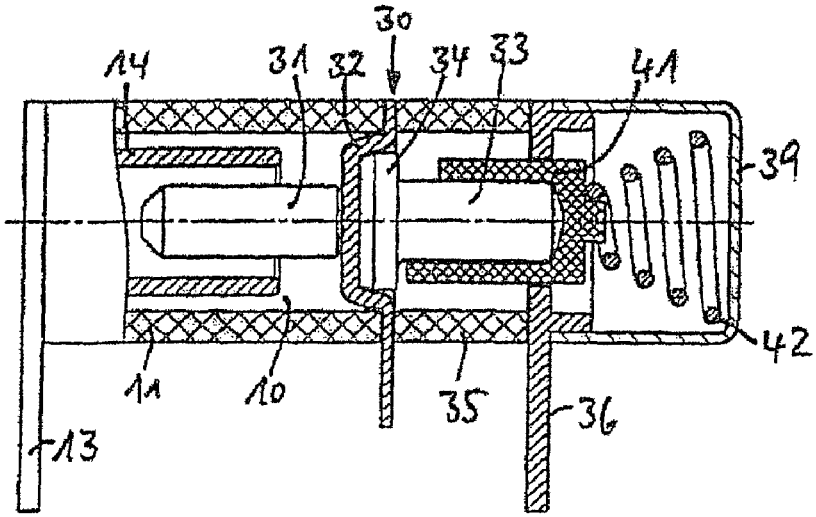

According to FIG. 2*b*, in the triggered state of the melt element, the insulation element 41 is pushed over the peg 33 of the one electrode of the overvoltage arrester or into the hole of the outer electrode with the help of the tension-relaxing spring 42. In this way, the free path available for an electric arc between the outer electrode 36 from the one electrode of the overvoltage arrester is made longer. In this embodiment, when the melt element is triggered, the internal space 10 of the overvoltage arrester is completely maintained.

An electric arc generated by the separation of the one electrode 30 and the outer terminal 36 is extinguished, on one hand, by the long insulation paths of the insulation element 41. However, it is also possible to fill the internal space formed between the insulation tube 35 and the pin 33 of the one electrode with a gas or a material that supports, for the case of an electric arc, the extinction of the electric arc.

The description of the disclosed objects and methods is not limited to the individual, special embodiments. Instead, the features of the individual embodiments, if technically meaningful, can be combined with each other arbitrarily. Thus, the described object and method could also be realized, e.g., with a tubular electrode instead of a pin electrode.

The invention claimed is:

1. An overvoltage arrester comprising:
- a first outer terminal;
- a second outer terminal;
- a first electrode;
- a second electrode that is insulated from the first electrode and is coupled to the second outer terminal;
- a melt element that connects the first electrode to the first outer terminal; and
- an extinguishing device that is triggered by melting of the melt element and that is designed to extinguish an electric arc.

2. The overvoltage arrester according to claim 1, wherein the outer integrity of the overvoltage arrester is maintained when the extinguishing device is triggered.

3. The overvoltage arrester according to claim 1, wherein the first electrode is movable into a position at a distance from a second electrode by means of the extinguishing device.

4. The overvoltage arrester according to claim 1, wherein the extinguishing device has a spring that is supported against a holder of the first electrode and applies tension to the melt element.

5. The overvoltage arrester according to claim 4, wherein the spring comprises a compression spring that is biased between one of the first and second outer terminals and the first electrode.

6. The overvoltage arrester according to claim 1, further comprising an insulation element that is movable by means of the extinguishing device into a position between the first outer terminal and the first electrode.

7. The overvoltage arrester according to claim 6, wherein the insulation element has a pot-shaped construction, wherein a wall is movable with the help of a spring between the first electrode and the first outer terminal.

8. The overvoltage arrester according to claim 7, wherein the spring is supported against a holder and the insulation element and wherein, on its free end, the insulation element applies pressure to the melt element.

9. The overvoltage arrester according to claim 1, wherein the melt element comprises an element that melts when heated and releases a gas with properties that extinguish an electric arc.

10. The overvoltage arrester according to claim 1, wherein the extinguishing device is arranged in a space separated from the second electrode.

11. An apparatus comprising:
- an overvoltage arrester comprising:
  - a first outer terminal;
  - a second outer terminal;
  - a first electrode;
  - a second electrode that is insulated from the first electrode and is coupled to the second outer terminal;
  - a melt element that connects the first electrode to the first outer terminal; and
  - an extinguishing device that is triggered by melting of the melt element and that is designed to extinguish an electric arc; and
- a device electrically connected to the overvoltage arrester.

12. The apparatus according to claim 11, wherein the apparatus comprises at least a portion of a power grid.

13. The apparatus according to claim 11, wherein the apparatus comprises a telecommunications device.

14. A method for protecting an overvoltage arrester from thermal overload, the overvoltage arrester comprising an extinguishing device, a second electrode that is insulated from a first electrode and is coupled to a second outer terminal, and a melt element that connects the first electrode to a first outer terminal, the method comprising:
- triggering the extinguishing device by melting the melt element for the case of thermal overload;
- extending a section that is formed from the second electrode of the overvoltage arrester to the first electrode of the overvoltage arrester or to the first outer terminal; and
- maintaining the outer integrity of the overvoltage arrester during the triggering and extending.

15. The method according to claim 14, wherein the extension of the section is realized by a relative movement between the first electrode and the second electrode of the overvoltage arrester.

16. The method according to claim 14, further comprising activating a contact element that generates an electric signal.

17. The method according to claim 14, wherein the extension of the section is moved by moving an insulation element into a space freed by the melted melt element.

18. The method according to claim 14, wherein the extending comprises extending the section that is formed from the second electrode of the overvoltage arrester to the first electrode of the overvoltage arrester.

19. The method according to claim 14, wherein the extending comprises extending the section that is formed from the second electrode of the overvoltage arrester to the first outer terminal.

* * * * *